US005556262A

United States Patent [19]

Achten et al.

[11] Patent Number: 5,556,262

[45] Date of Patent: Sep. 17, 1996

[54] FREE-PISTON ENGINE HAVING A FLUID ENERGY UNIT

[75] Inventors: Peter A. J. Achten, Eindhoven; Theodorus G. Potma, Kaag, both of Netherlands

[73] Assignee: Innas Free Piston B.V., Breda, Netherlands

[21] Appl. No.: 244,150

[22] PCT Filed: Nov. 19, 1992

[86] PCT No.: PCT/NL92/00209

§ 371 Date: May 18, 1994

§ 102(e) Date: May 18, 1994

[87] PCT Pub. No.: WO93/10342

PCT Pub. Date: May 27, 1993

[30] Foreign Application Priority Data

Nov. 19, 1991 [NL] Netherlands ..... 9101931

[51] Int. Cl.[6] ..... F02B 71/04; F02B 71/02; F01B 11/02

[52] U.S. Cl. ..... 417/364; 417/380

[58] Field of Search ..... 417/364, 380

[56] References Cited

U.S. PATENT DOCUMENTS

| | | | |
|---|---|---|---|
| 3,216,651 | 11/1965 | King et al. | 417/364 |
| 3,606,591 | 9/1971 | Potma | 417/364 |
| 4,210,046 | 7/1980 | Beerens | 91/394 |
| 4,307,999 | 12/1981 | Vanderlaan | 417/364 X |
| 4,705,460 | 11/1987 | Braun | 417/364 X |
| 4,791,786 | 12/1988 | Stuyvenberg | 417/380 X |

FOREIGN PATENT DOCUMENTS

| | | | |
|---|---|---|---|
| 0254353 | 1/1988 | European Pat. Off. . | |
| 1346877 | 11/1963 | France | 417/367 |
| 6814405 | 4/1970 | Netherlands . | |
| 1372809 | 11/1974 | United Kingdom . | |

*Primary Examiner*—Richard E. Gluck
*Attorney, Agent, or Firm*—Kinney & Lange

[57] ABSTRACT

A free-piston engine having a fluid energy unit comprises a cylinder and a piston reciprocating within the cylinder. The piston is equipped with a plunger-shaped extension including a first axial face moving within a chamber when the piston is moved. There are supply means for supply of liquid from a reservoir to the chamber and discharge means for discharge of fluid from the chamber to an accumulator. The plunger-shaped extension further comprises an axial face opposite the first axial face and bordering a pressurized room in the top dead center of the piston. The hydraulic unit further includes a compression section for making a compression stroke of the piston. The discharge means include separate first and second discharge channels. The first discharge channel connects to the chamber in such a manner that a discharge of liquid from the chamber to the accumulator can take place only in a first part of the expansion stroke of the piston and the first discharge channel having a low flow resistance. The second discharge channel connecting to a pressurized room in such manner that a discharge of liquid from this room to the accumulator can take place in a last part of the expansion stroke of the piston. The second discharge channel including a quickly closing non-return valve preventing a flow of liquid to the pressurized room.

6 Claims, 5 Drawing Sheets

FREE-PISTON ENGINE HAVING A FLUID ENERGY UNIT

BACKGROUND OF THE INVENTION

The invention relates to a free-piston engine having a fluid energy unit.

In a known embodiment of such a free-piston engine (see EP-A-0 254 353), the supply and discharge means of the displacement chambers consist of a supply and discharge channel having a non-return valve. At the end of the movement of the piston from the second to the first position, that is at the end of the expansion stroke, the non-return valve of the discharge channel closes so that the pressure in the respective chamber becomes lower than the pressure in the accumulator together with the spring pressure of the valve. The closing action of the non-return valve should take place quickly because otherwise hydraulic liquid will flow back to the chamber which will cause the piston to move back to the second position along some distance, while it is the intention to retain the piston in its first position until a new compression and expansion stroke is required. The quick closing action of the non-return valve necessitates a high spring pressure in the non-return valve. This results, however, in a high flow resistance when hydraulic liquid flows through this non-return valve during the expansion stroke of the piston causing substantial flow losses.

The object of the present invention is to provide a free-piston engine having a fluid energy unit in which this disadvantage is removed in an effective way.

SUMMARY OF THE INVENTION

Due to the features according to the invention, the discharge channel means having a LOW FLOW resistance are used during the first part of the expansion stroke so that low hydraulic losses occur. At the end of the expansion stroke, when the speed of the piston is reduced substantially, the first discharge channel means are put out of action and the discharge of hydraulic liquid from the chamber only takes place through the second discharge channel means having a quick non-return valve and a small waste volume. In this manner, both opposite objectives of low flow resistances and small rebound of the piston from the bottom dead centre are obtained in an effective way.

NL-A-6 814 405 discloses a free-piston engine having a fluid energy unit, which comprises separate first and second discharge channel means operating in a first and second part of the expansion stroke, respectively, and in a second and first part of the compression stroke. The first discharge channel means has a low flow resistance and the second discharge channel means includes a regulator to control the speed of the piston in the first part of the compression stroke to thereby control the stroke frequency of the engine.

BRIEF DESCRIPTION OF THE DRAWINGS

The invention will hereafter be elucidated with reference to the drawings showing embodiments of the free-piston engine according to the invention by way of example.

DETAILED DESCRIPTION OF THE PREFERRED EMBODIMENTS

Figure 1:
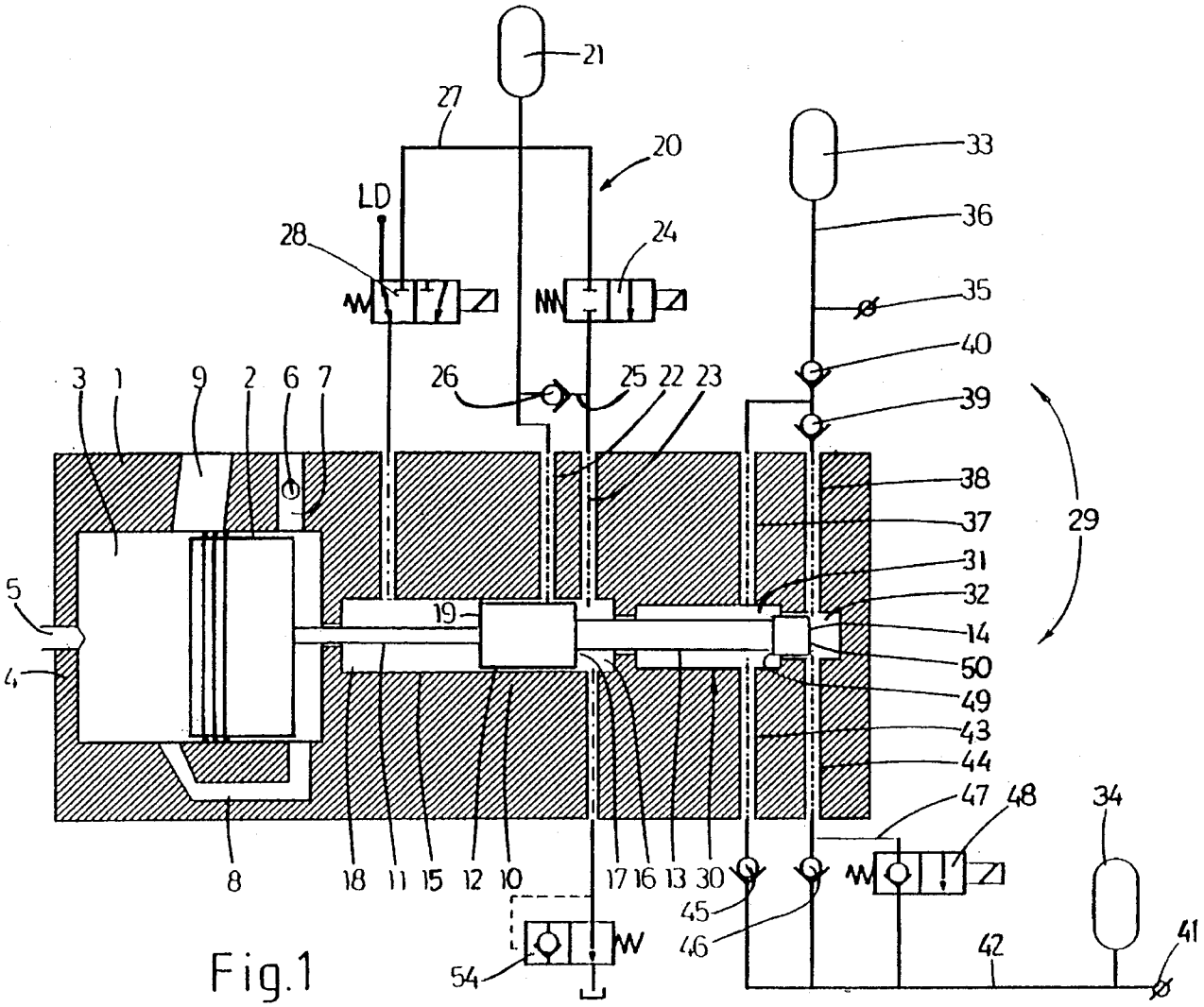
FIG. 1 is a very schematic longitudinal section of a free-piston engine showing a simplified scheme of the corresponding hydraulic unit.

FIG. 1 shows schematically a first exemplary embodiment of a free-piston engine having a hydraulic energy unit according to the present invention. This free-piston engine includes a cylinder 1 and a piston 2 arranged within the cylinder 1, bordering one side of a combustion room 3 and reciprocating in the cylinder 1 between a first position in which the volume of the combustion room 3 in the cylinder 1 is at a maximum (the so-called bottom dead centre, BDC), and a second position in which the volume of the combustion room 3 in the cylinder 1 is at a minimum (the so-called top dead centre, TDC). The free-piston engine according to the invention operates as a diesel engine, in which fuel is injected into the combustion room 3 filled with compressed combustion air, the fuel-air mixture igniting by spontaneous combustion. For this purpose, a cylinder head 4 bordering the combustion room 3 on the side facing away from the piston 2 carries an injector 5 for indirectly or directly injecting liquid fuel such as diesel oil. For sucking-in air an inlet channel 7 having a non-return valve 6 connects to the room in the cylinder 1 below the piston 2, and air is sucked-in by displacement of the piston 2 from said first position to said second position, that is during the compression stroke. A connecting or scavenge channel 8 ensures that the air sucked-in through the inlet channel 7 during the expansion stroke of the piston 2, that is from the second position to the first position of the piston 2, is conducted from the room under the piston 2 to the combustion room 3 above the piston 2. The combustion gasses produced after combustion of the fuel-air mixture are discharged through an outlet channel 9.

On the side of the piston 2 facing away from the combustion room 3 is formed a plunger-shaped extension 10 guiding the piston 2 in its rectilinear reciprocating movement on the one hand, but the most important function of which is the conversion of mechanical energy rendered to the piston 2 during the combustion of the fuel-air mixture in the combustion room 3 into hydraulic energy, and also to convert hydraulic energy into mechanical energy in the piston 2 for making the compression stroke of the piston 2.

For these functions the plunger-shaped piston extension 10 includes in this first embodiment—as seen from the piston 2—a first rod section 11 of small diameter, a joining first plunger section 12 of greater diameter, a second rod section 13 of a diameter between that of the first rod section 11 and that of the first plunger section 12, and on the free end of the plunger-shaped extension 10 a second plunger section 14 of a slightly greater diameter than that of the second rod section 13.

A compression section 20 of the hydraulic energy unit adapted to allow the piston 2 to make the compression stroke comprises the following parts.

In the engine block is formed a first chamber 15 of which a room 16 is closed on one side by a first axial face 17 formed on one end of the first plunger section 12. The volume of this room 16 in the first chamber 15 is increased during the expansion stroke of the piston 2 from its first to its second position. On the other side of the first plunger section 12 is formed a room 18 which is movably closed by a further axial face 19 of the first plunger section 12.

Figure 2:
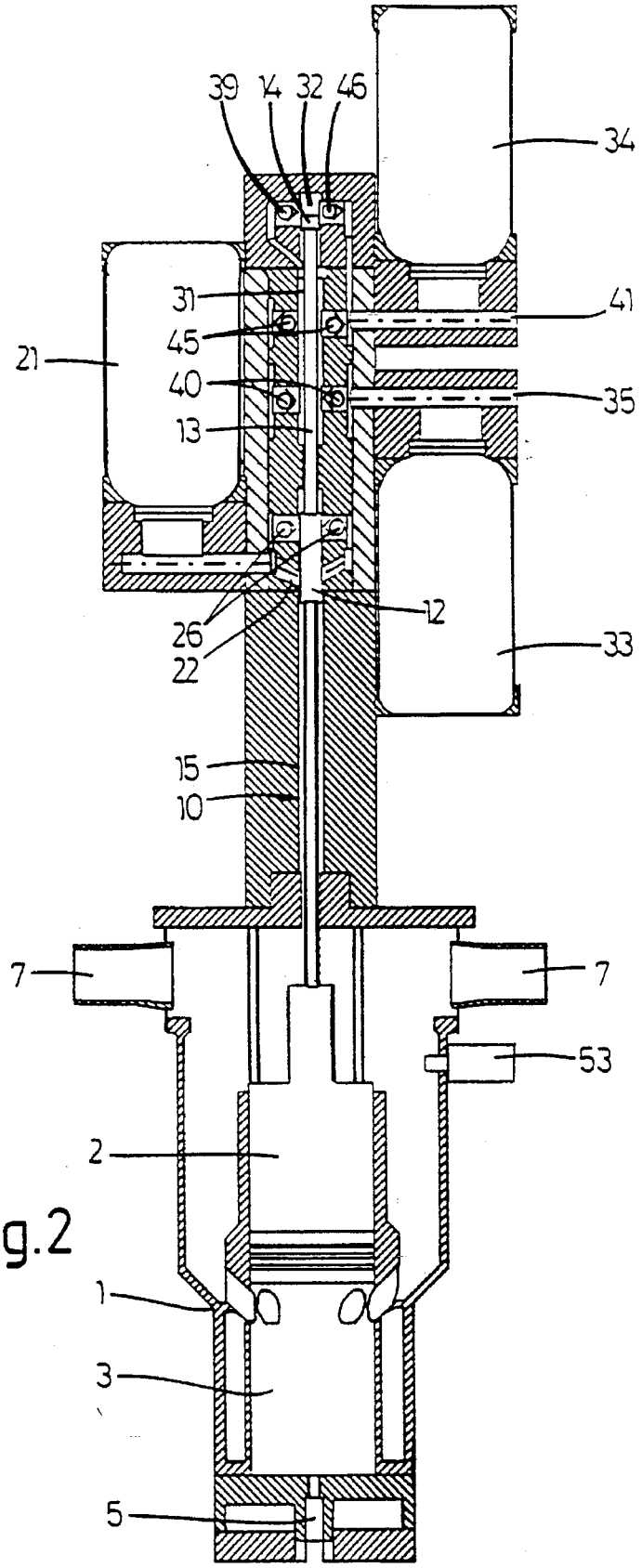
FIG. 2 is a longitudinal sectional view of a more realistic structural embodiment of the free-piston engine having the hydraulic energy unit of FIG. 1.

The compression section 20 of the hydraulic energy further comprises a compression pressure accumulator 21 connecting to the rooms 16 and 18 of the first chamber 15 via a number of channels or lines. A first connecting channel 22 connects to the first chamber 15 in such a position that an effective connection between the room 16 of the first chamber 15 and the compression pressure accumulator 21 is only possible in positions of the piston adjacent the top dead centre of the piston 2, that is during a last, but minor, part of the expansion stroke of the piston 2, and during a first part of the compression stroke of the piston 2 the connecting channel 22 is closed by the circumferential wall of the first plunger section 12 which fits into the first chamber 15. The connecting channel 22 has a low flow resistance and has preferably no valves so that the connection between the room 16 in the first chamber 15 and the compression pressure accumulator 21 are fully controlled by the first plunger section 12 of the piston extension 10. A second connecting channel 23 is provided with a two-way valve 24 in a first position of which the second connecting channel 23 being closed (see FIG. 1) and in a second position of which hydraulic fluid being allowed to flow from the pressure accumulator 21 to the room 16 of the first chamber 15. Between the first and second connecting channels 22, 23 is an intermediate line 25 having a non-return valve 26 which is of the quickly closing type and only allows passage of hydraulic liquid from the room 16 of the first chamber 15 to the pressure accumulator 21. This non-return valve 26 may be conventional and a heavy spring may cause the quick closing action of the valve. The non-return valve 26 is arranged as close as possible to the room 16 in the first chamber 15, as is shown in FIG. 2.

A third connecting channel 27 may effect a connection between the room 18 of the first chamber 15 and the pressure accumulator 21 in the event that the engine should be started and the piston 2 should be brought to its bottom dead centre, or in the event of a so-called "misfiring" in which the combustion in the combustion room 3 has not been sufficient to cause the piston 2 to make a sufficient expansion stroke and then the piston 2 should be brought to the bottom dead centre by means of the pressure from the pressure accumulator 21. For this purpose, a two-way valve 28 in the third connecting channel 26 is switched to the position in which hydraulic liquid is enabled to flow from the pressure accumulator 21 to the room 18 in the first chamber 15 so that a compression pressure is exerted on the further axial face 19 of the first plunger section 12. In the normal operative position of the free-piston engine, the two-way valve 28 is in the position shown in FIG. 1 in which the room 18 of the first chamber 15 communicates with a low pressure reservoir (not shown).

To the room 16 near the connecting channel 23 connects an escape valve 54 and during the compression stroke of the piston 2 it is moved by the pressure from the compression pressure accumulator 21 to a position in which it operates as non-return valve preventing discharge of hydraulic liquid from the room 16 and only when the piston 2 stands still it is urged by a set-back spring into a position allowing discharge from the room 16.

The working section of the hydraulic energy unit of the free-piston engine according to the invention, generally indicated by reference numeral 29, comprises the following parts.

The second rod section 13 and the second plunger section 14 are allowed to move within a second chamber 13 divided into a first chamber portion 31 of a diameter equal to or in this case greater than the diameter of the plunger section 14, and a second chamber portion 32 of a diameter adapted to that of the second plunger section 14 so that the second plunger section 14 sealingly fits in the second chamber portion 32. The second plunger section 14 includes a first axial face 49 upon which the pressure in the first chamber portion 31 of the second chamber 30 can act and a second axial face 50 opposite to the first axial face and bordering the second chamber portion 32 in the bottom dead centre of the piston 2.

The working section 29 of the hydraulic energy unit includes two pressure accumulators, a high pressure accumulator 33 and a low pressure accumulator 34. The high pressure accumulator 33 is designed for use as accumulator for working pressure on behalf of a user connected at connection 35. The user may, for example, exist of a wheel of a vehicle driven by the free-piston engine via the hydraulic energy unit. The connection 35 for the user connects to a discharge line 36 for discharging hydraulic liquid from the second chamber 30 during the expansion stroke of the piston 2. A first discharge channel 37 connects to the first chamber portion 31 of the second chamber 30, while a second discharge channel 38 connects to the second chamber portion 32 of the second chamber 30. The first discharge channel 37 opens into the second discharge channel 8, wherein between the connection of the first discharge channel 37 to the second discharge channel 38 and the second chamber portion 32 of the second chamber 30 a quick non-return valve 39 is received in the second discharge channel 38 in a position close to the second chamber portion 32. Beyond the connection of the first discharge channel 37 is a second non-return valve 40 in the second discharge channel 38. The first discharge channel 37 and the non-return valve 40 have a low flow resistance, and the non-return valve 39 being a quickly closing non-return valve. For this purpose, the non-return valve 39 preferably has a heavier spring than the non-return valve 40.

The low pressure accumulator 34, to which a discharge of the user at connection 41 may connect, has a supply line 42 dividing into a first supply channel 43 connecting to the first chamber portion 31 of the second chamber 30 and a second supply channel 44 communicating with the second chamber portion 32 of the second chamber 30. The first supply channel 43 includes a non-return valve 45 having a low flow resistance and the second supply channel 44 includes a quickly closing non-return valve 46, both non-return valves 45, 46 allow a flow of hydraulic liquid only from the low pressure accumulator 34 to the second chamber 30. A bypass line 47 passes the non-return valve 46 in the second supply channel 44 and includes a two-way valve 48 normally acting as a non-return valve and, only in the event that the piston 2 should be brought by the compression pressure accumulator 21 to its bottom dead centre, acts as pressure-relief valve for relieving the second chamber portion 32 of the second chamber 30.

The operation of the free-piston engine having a hydraulic energy unit described above is as follows.

In FIG. 1, the piston 2 is shown in its bottom dead centre, that is in its first position. In this position the compression stroke of the piston 2 is about to start. For this purpose, the two-way valve 24 is moved to its open position in which hydraulic liquid is allowed to flow from the pressure accumulator 21 to the room 16 in the first chamber 15. Hydraulic pressure is then exerted on the first axial face 17 of the first plunger section 12 of the piston extension 10 causing the piston 2 to move from its bottom dead centre. By increasing the volume of the second chamber portion 32 of the second chamber 30 hydraulic liquid is sucked-in from the low pressure accumulator 34 through the second supply channel 44 and the non-return valve 46.

As soon as the plunger section 12 of the piston extension 10 is moved sufficiently far (in FIG. 1 to the left) and hence the piston 2 has made a first part of the compression stroke, the first plunger section 12 opens the first connecting channel 22 allowing hydraulic liquid to flow through the first connecting channel 22 having a low flow resistance to the room 17 of the first chamber 15, and the piston 2 is forced to make the second part of the compression stroke with great speed. In the meantime, also the second plunger section 14 has left the second chamber portion 32 of the second chamber 30 and hydraulic liquid is sucked-in into the second chamber 30 from the low pressure accumulator 34 both through the first supply channel 43 and through the second supply channel 44.

The control of the hydraulic energy unit will be such that the piston 2 receives sufficient energy to make a compression stroke of the desired length in order to sufficiently compress air arrived in the combustion room 3 through the inlet channel 6 and the connecting channel 8 and to effect, after injection of fuel through the injector 5, a proper spontaneous combustion of the fuel-air mixture.

During the expansion stroke of the piston 2, the volume of the room 16 in the first chamber 15 is reduced by the plunger section 12 and hydraulic liquid is forced back from this room 16 to the pressure accumulator 21 through the first connecting channel 22 having a low flow resistance. Due to the low flow resistance of the first connecting channel 22 the first plunger section 12 and hence the piston 2 encounters minimal losses. In the working section 29 of the hydraulic energy unit, the non-return valve 45 and 46 have been closed at the beginning of the expansion stroke and by the decreases of the volume in the second chamber 30 hydraulic liquid is conducted to the high pressure accumulator 33 and/or via the connection 35 to the user, mainly through the first supply channel 37 and the non-return valve 40. Due to the low flow resistance in the first discharge channel 37 and in the non-return valve 40, the piston 2 encounters minor losses in this case also.

In the second part of the expansion stroke, near the bottom dead centre of the piston 2 where the speed of the piston 2 and the piston extension 10 is reduced substantially, the first connecting channel 22 is closed by the circumferential wall of the first plunger section 12 of the piston extension 10 so that hydraulic liquid from the room 16 of the first chamber can only be returned to the pressure accumulator 21 through the second connecting channel 23 and the non-return valve 26 in the intermediate line 25. The higher flow resistance thereof is not a big problem since the speed of the piston 2 is reduced considerably.

In the working part 29 of the hydraulic energy unit, near the end of the expansion stroke of the piston 2, the second plunger section 14 has arrived in the second chamber portion 32 of the second chamber 30 and a discharge of hydraulic liquid from the second chamber 30 is only taking place through the second discharge channel 38 and the non-return valves 39 and 40. The first chamber portion 31 remains at working pressure supplied by a part of the liquid from the second chamber portion 32 through the first discharge channel 37.

The free-piston engine according to the invention is of the intermittent type, that is that when the piston 2 has arrived in the bottom dead centre a new compression and expansion stroke is only carried out by the piston if it is necessary due to demands of the user or if the pressure in the high pressure accumulator 33 has not reached its maximum. This means that the piston 2 should be retained in a position ready to make a new compression and expansion stroke. The more accurate this starting position can be controlled, the more accurate the subsequent compression and expansion stroke can be carried out.

According to the invention, this starting position of the piston 2 in its bottom dead centre is held as a result of the pressure in the first chamber portion 31 acting upon the axial face 49 of the second plunger section 14 and hence retaining the whole piston 2. It is true that at the end of the expansion stroke also the working pressure still acts upon the opposite axial face 50 of the plunger section 14, but due to a very small rebound of the piston 2 this pressure drops very quickly to the pressure in the low pressure accumulator 34 due to the expansion of the hydraulic liquid in the chamber portion 32 and in some cases the non-return valve 46 even opens. This quick expansion of the hydraulic liquid in the chamber portion 32 and the pressure drop associated therewith should be made possible by closing the non-return valve 39 because otherwise liquid under high pressure will flow into the chamber portion 32. As a result, the non-return valve 39 should be of the quickly closing type and in the most favourable case this valve is almost closed already when the piston 2 arrives in its bottom dead centre. Preferably, also non-return valve 46 should be able to close quickly because otherwise there is a risk that due to an unbalance in the equilibrium of forces on the plunger section 14 (then there is a high pressure in the chamber portion 31) the piston 2 moves again to and possibly beyond the bottom dead centre. This is illustrated in FIG. 4 where the uninterrupted line illustrates the piston movement (as function of the time) when the hydraulic energy unit is designed in accordance with FIG. 1 or 3, while the interrupted line indicated by A illustrates the piston movement which would occur if the supply and discharge means would not have been provided with the division into channels having a low flow resistance and small channels having quick non-return valves. Due to the too slow closing action of the single bigger less quick non-return valve, in the bottom dead centre of the piston 2 a connection between chambers 16, 32 and accumulators 21, 33 respectively is maintained too long as a result of which the plunger 10 rebounds so far that supply channel 22 is opened by plunger section 12 and an unwanted new compression stroke of the piston 2 is started. The interrupted line P in FIG. 4 illustrates the possible piston displacement if the supply means of the low pressure section does not include a division into a first channel 43 having a low flow resistance and a big non-return valve 45 and a second small channel 44 having a quick non-return valve 46. During the rebound of the plunger 10 in the bottom dead centre of the piston 2 the low pressure in the chamber 32 opens the non-return valve 46, whereafter this valve 46 does not close quick enough when the plunger 10 is pushed again to the bottom dead centre by the high pressure in chamber 31. As a result thereof the piston 2 shoots past the bottom dead centre and consequently no proper starting position for the next expansion stroke is obtained.

Due to the features according to the invention, however, the equilibrium of forces is automatically maintained by very small displacements of the plunger section 14. These movements and particularly the first rebound can be kept to a minimum by the quickly closing non-return valves 36, 39 and 46 and also by minimizing the volume of the room 16 and of the second chamber portion 32 and especially the channels 23, 38 and 44, respectively, connecting thereto. This is obtained by arranging the non-return valves 26, 39 and 46 as close as possible to the respective chamber, as shown in FIG. 2.

Figure 5B:
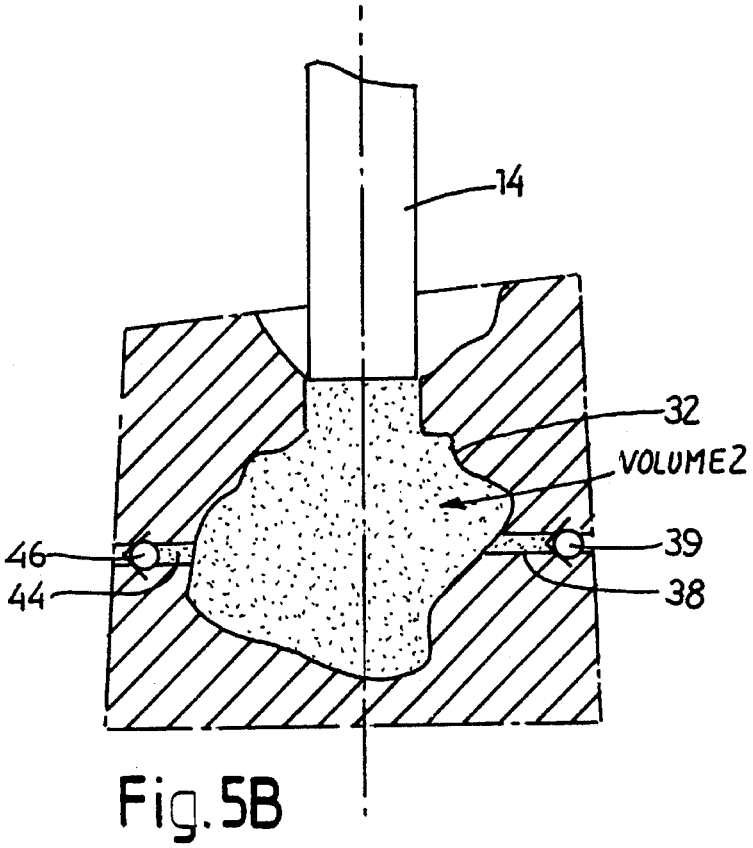
FIG. 5A, B illustrate the waste volume of hydraulic liquid in a displacement chamber at the end of the expansion stroke of the piston.
Figure 5A:
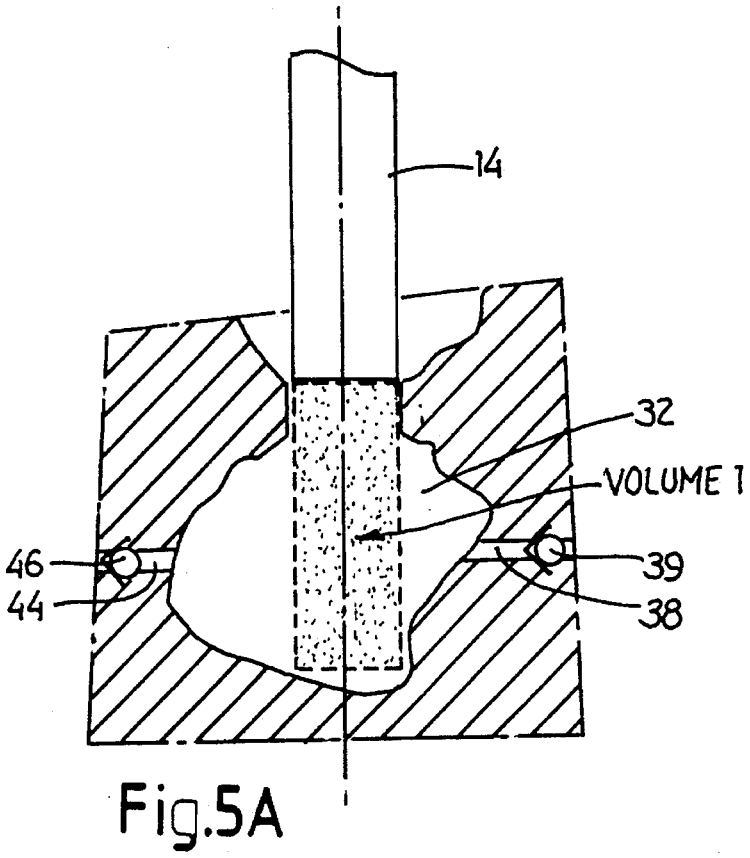

FIG. 5A, B illustrate the volumes playing a part therein. FIG. 5A shows the position of the plunger section 14 in which it just closes the second chamber portion 32 and consequently liquid can then only be discharged through the non-return valve 39 in the channel 38. The interrupted line in FIG. 5A encloses the volume 1 under the plunger section 14 which can be displaced up to the mechanical stop. This volume 1 is determined by the structure and can hardly be influenced by the present invention. Which can be influenced, however, is volume 2 indicated in FIG. 5B which includes beside volume 1 also the waste volume, that is all the volume of arbitrary spaces outwardly of the plunger projection up to the non-return valves 39 and 46 in the channels 38 and 44. Volume 2 - Volume 1 should be kept as small as possible to minimize the rebound of the piston due to expansion of the hydraulic liquid when the non-return valves 39 and 46 are closed. The differential volume or waste volume, that is volume 2 - volume 1, is preferably less than 300% of volume 1. This can be obtained by designing the channels 38, 44 and the non-return valves 39 and 46 arranged therein with a diameter which is as small as possible and also by positioning the non-return valves 39 and 46 as close as possible to the chamber portion 32.

The first rebound of the piston 2 from the bottom dead centre, as illustrated in FIG. 4, is not only preferably as small as possible, but it is advantageous if this rebound is independent of the working pressure in the high pressure accumulator 33. In the embodiment of FIG. 1 this will not be the case, however, because the counter pressure on the second plunger section 14 against the axial face 49 is determined by the working pressure of the high pressure accumulator 33 which is variable so that also the retaining force on the axial face 49 is variable and when the working pressure is low a large rebound should be accepted before an equilibrium of forces is obtained.

From the retained position of the piston 2 near the bottom dead centre, the piston 2 is allowed to start another compression stroke by opening the two-way valve 24, if there is a demand from the user or if the pressure in the high pressure accumulator 33 is too low. The escape valve 54 is then switched immediately to a discharge preventing non-return valve.

Figure 3:
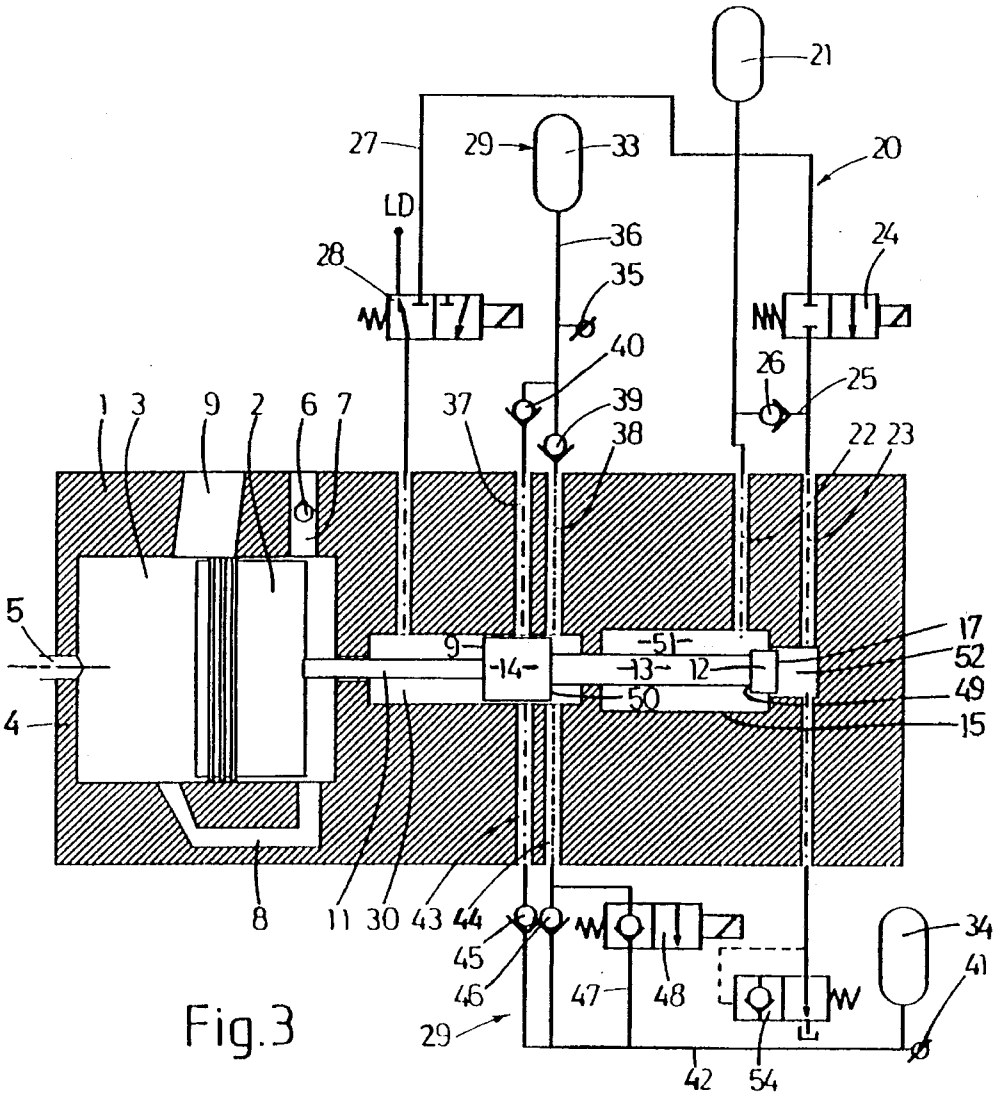
FIG. 3 is a sectional view corresponding to FIG. 1 but showing a second embodiment of the free-piston engine together with a hydraulic energy unit.
Figure 4:
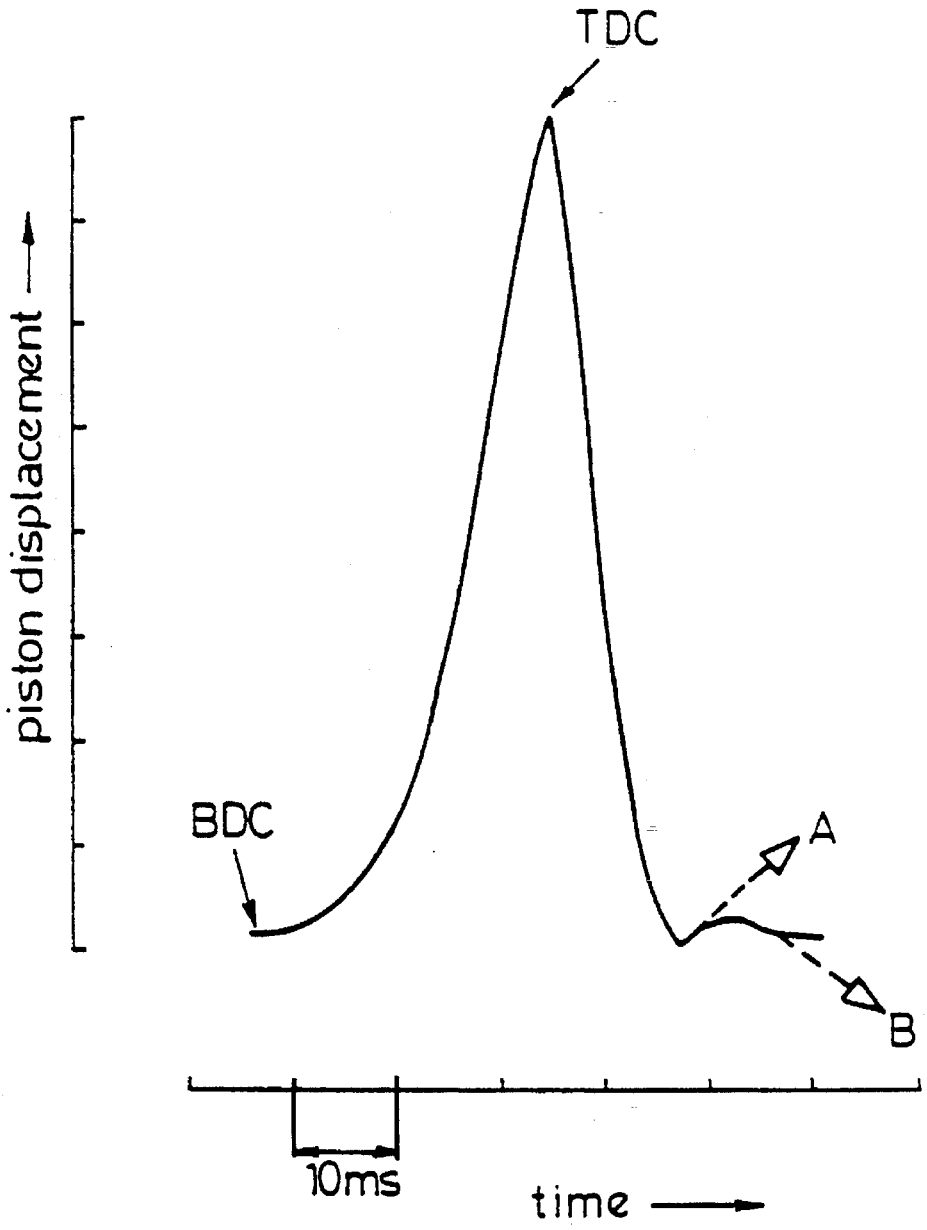
FIG. 4 is a diagram illustrating the piston displacement as a function of time.

A further improved embodiment of the free-piston engine having a hydraulic energy unit according to the present invention is shown in FIG. 3. Functionally corresponding parts are indicated with the same reference numerals.

As shown in FIG. 3, the plunger sections 12 and 14 and their respective compression section 20, and working section 29, respectively have changed places. The first chamber 15 is now divided into a first chamber portion 51 of a diameter equal to or in this case greater than that of the first plunger section 12, and a second chamber portion 52 of a diameter adapted to that of the first plunger section 12, so that the first plunger section accurately fits into the second chamber portion 52 of the first chamber 15. In the drawn bottom dead centre of the piston 2, the second chamber portion 52 of the first chamber 15 is in open communication with the compression pressure accumulator 21, so that the first plunger section 12 encounters a counter pressure of the compression pressure from the accumulator 21 against the axial face 49 of the first plunger section 12 when the piston 2 rebounds in the bottom dead centre after the compression stroke. Since the compression pressure of the pressure accumulator 21 is substantially constant, also the counter pressure in the rebound from the bottom dead centre is substantially constant, resulting in a substantially constant rebound independent of the working pressure in the high pressure accumulator 33. Of course the surface 49 should be adapted in size to the compression pressure. The room behind the second plunger section 14 in the second chamber 30 communicating with the second discharge channel 37 is then made pressureless by ventilating it with the environment or a low pressure reservoir through the two-way valve 28. The operation of the free-piston engine having the hydraulic energy unit according to this embodiment is for the rest similar to the embodiment of FIG. 1.

In FIG. 2 it is further shown that the housing of the cylinder 1 carries a sensor 53 adapted to cooperate with a counter means mounted to the piston 2 or to the plunger shaped extension 10. This sensor 53 is adapted to sense whether the piston 2 has made a sufficient expansion stroke and no "misfiring" has occurred. In the latter case, valves 28 and 48 should be actuated to hydraulically finish the expansion stroke. According to the invention, the sensor 53 and the counter means (not shown) are now positioned such that the sensor only registers a sufficient stroke if the first plunger 12 is moved sufficiently far to avoid a connection of the room 16 and the connecting channel 22 also after its rebound in the bottom dead centre. As a result it is not possible that a compression stroke starts unintentionally after the rebound.

The invention is not restricted to the embodiments shown in the drawing which may be varied in different manners within the scope of the invention. It is for example possible that the compression section of the energy unit is pneumatic. The division of the supply and discharge means may or may not be used there.

What is claimed is:

1. Free-piston engine having a fluid energy unit including one or more pressure accumulators, the free-piston engine comprising a cylinder and a piston within the cylinder limiting one side of a combustion room and reciprocating in the cylinder between a first position in which the volume of the combustion room in the cylinder is at a maximum, and a second position in which the volume of the combustion room in the cylinder is at a minimum, an expansion stroke of the piston from the second to the first position taking place by expansion pressure within the combustion room and mechanical energy rendered to the piston by the expansion pressure being converted into hydraulic energy within the engine, the piston being equipped with a plunger-shaped extension comprising first, second and third axial faces, wherein at least the first and third axial faces limit displacement rooms the volume of which is reduced during the expansion stroke of the piston, said displacement rooms comprising supply and discharge means for supplying and discharging fluid to and from the respective displacement rooms from and to said at least one or more pressure accumulators, and at least the second axial face directed opposite to said third axial face and limiting a pressurized room in the first position of the piston in order to hold the piston in said first position prior to moving back to the second position, characterized in that of at least all displacement rooms of which the fluid contained therein is a liquid, the supply and discharge means connecting thereto comprise separate first and second channel means, and that the plunger-shaped extension drives displaceable closure means preventing discharge or supply, respectively, of liquid from or to, respectively, the displacement room via the first channel means unless during a first part of the expansion stroke and a second part of the compression stroke of the piston, respectively, and the first channel means having a low flow resistance, the second channel means comprising a quickly closing non-return valve and having a small waste volume of liquid at the end of the expansion stroke of the piston by arranging said quickly closing non-return valves near to the respective displacement rooms.

2. Free-piston engine according to claim 1, wherein a further non-return valve having a low flow resistance is arranged in the first discharge channel means of the second chamber.

3. Free-piston engine according to claim 1, wherein the compression section of the hydraulic unit comprises a compression pressure accumulator connectable on a first one of the displacement rooms for exerting a pressure force to the third axial face of the plunger-shaped extension, connecting means arranged between the compression pressure accumulator and the first displacement room, which include separate first and second connecting channel means connecting to the first displacement room, and that the closure means driven by the plunger-shaped extension prevent effective connection with the compression pressure accumulator in the first position of the piston and the first connecting channel means having a low flow resistance, the second connecting channel means connect to a second one of the displacement rooms when the piston is in the first position, and the second connecting channel means including a first quickly closing non-return valve preventing a flow of liquid from the compression pressure accumulator to the second displacement room.

4. Free-piston engine according to claim 3, wherein the compression pressure accumulator connects to the second displacement room which comprises a further plunger section having the third axial face and wherein the second displacement room includes two portions of which a first portion is of greater diameter than a second portion, the first connecting channel means connecting to the first portion of the second displacement room and the second connecting channel means connecting to the second portion of the second displacement room, and said third axial face of the first plunger section has a diameter adapted to the diameter of the second portion.

5. Free-piston engine according to claim 4, wherein the second axial face borders the pressurized room which is in open connection to the compression pressure accumulator when the piston is in the first position.

6. Free-piston engine according to claim 1, comprising a stationary sensor cooperating with a counter means connected to one of the piston and plunger-shaped piston extension, said sensor being adapted to sense whether the piston has made a sufficient stroke from the second to the first position, characterized in that the sensor and the counter means are positioned in such relationship that the sensor only senses a sufficient stroke if the plunger section is moved sufficiently far that also after it has sprung back from the first position the first connecting channel means will not be effectively be connected to the second displacement room.

* * * * *